US008564456B2

(12) United States Patent
Selevan

(10) Patent No.: US 8,564,456 B2
(45) Date of Patent: Oct. 22, 2013

(54) SEQUENCED VEHICULAR TRAFFIC GUIDING SYSTEM

(76) Inventor: James R. Selevan, Laguna Beach, CA (US)

( * ) Notice: Subject to any disclaimer, the term of this patent is extended or adjusted under 35 U.S.C. 154(b) by 0 days.

(21) Appl. No.: 13/440,930

(22) Filed: Apr. 5, 2012

(65) Prior Publication Data

US 2012/0256765 A1 Oct. 11, 2012

Related U.S. Application Data

(63) Continuation of application No. 12/381,565, filed on Mar. 14, 2009, now Pat. No. 8,154,424.

(60) Provisional application No. 61/069,473, filed on Mar. 15, 2008.

(51) Int. Cl.
*G08G 1/095* (2006.01)

(52) U.S. Cl.
USPC ..... 340/907; 340/984; 340/985; 441/6; 441/13

(58) Field of Classification Search
USPC ..... 340/984–985
See application file for complete search history.

(56) References Cited

U.S. PATENT DOCUMENTS

| | | | | |
|---|---|---|---|---|
| 3,500,378 | A | 3/1970 | Pickering et al. | |
| 3,787,867 | A | 1/1974 | Dodge et al. | |
| 4,132,983 | A * | 1/1979 | Shapiro | 340/331 |
| 4,827,245 | A | 5/1989 | Lipman | |
| 6,929,378 | B2 | 8/2005 | Wang | |
| 2002/0154787 | A1 | 10/2002 | Rice et al. | |
| 2002/0175831 | A1 | 11/2002 | Bergan et al. | |
| 2003/0164666 | A1 | 9/2003 | Crunk | |
| 2004/0056779 | A1 * | 3/2004 | Rast | 340/985 |
| 2004/0100396 | A1 * | 5/2004 | Antico et al. | 340/985 |
| 2006/0072306 | A1 * | 4/2006 | Woodyard | 362/157 |
| 2007/0038743 | A1 * | 2/2007 | Hellhake et al. | 709/224 |
| 2007/0222640 | A1 * | 9/2007 | Guelzow et al. | 340/908 |
| 2008/0091304 | A1 * | 4/2008 | Ozick et al. | 700/258 |
| 2009/0115336 | A1 * | 5/2009 | Wang | 315/136 |

OTHER PUBLICATIONS

Finley, M.D. et al., "Sequential Warning Light System for Work Zone Lane Closures," Texas Transportation System, (2011) pp. 1-23.
Sun, C. et al., "Cost-Benefit Analysis of Sequential Warning Lights in Nighttime Work Zone Tapers", University of Missouri, Report to the Smart Work Zone Deployment Initiative, Jun. 6, 2011.
Internet Website Screen Capture, www.empco-lite.com; Sep. 6, 2010.

* cited by examiner

*Primary Examiner* — Tai T Nguyen
*Assistant Examiner* — Ojiako Nwugo
(74) *Attorney, Agent, or Firm* — Robert D. Buyan; Stout, Uxa, Buyan & Mullins, LLP

(57) ABSTRACT

A system for marking a route, path or boundary. The system may comprise a plurality of modules, each of which comprises a signaling device, a radiofrequency apparatus and control circuitry. Such modules are positionable in an array which marks the route, path or boundary. When positioned in the array, the modules undergo radiofrequency communication with one another and the control circuitry causes the signaling devices of the modules to emit warning signals in sequence from a first-positioned module of the array to a last-positioned module of the array.

19 Claims, 5 Drawing Sheets

SEQUENCED VEHICULAR TRAFFIC GUIDING SYSTEM

RELATED APPLICATIONS

This application is a continuation of copending U.S. patent application Ser. No. 12/381,565 filed Mar. 14, 2009 which claims priority to U.S. Provisional Patent Application No. 61/069,473 filed Mar. 15, 2008, the entire disclosure of each such application being expressly incorporated herein by reference.

FIELD OF THE INVENTION

This invention relates generally to devices and methods for traffic control to aid in navigation on land, sea, and air.

BACKGROUND OF THE INVENTION

Flashing orange traffic safety lamps are commonplace along highways and waterways. Passive cones are often used to mark the boundaries or edges of roadways. They are used during road construction, traffic detours, and for emergency to route traffic through unfamiliar redirection. These passive cones are typically used over an entire 24-hour period, which includes darkness and may include poor visibility. Always on, or blinking, lights or reflectors are often used to define the border of a road that has temporarily changed and no longer follows the path that drivers expect or have become use to seeing. As shown in FIG. 1, when the detour includes a curve, the flashing light can be seen across the curve, creating confusion and disorientation. Curved roads or pathways can cause more confusion than straight roads or pathways due to human inability to judge distances, especially at night. The size of the lights or markers may not appear to substantially change in size with increasing distance from the observer. In addition, nautical buoys used to guide vessels into harbors or around dangerous shallows can sometimes be confusing and difficult to interpret.

Current alternatives do not exist. Traffic is often controlled using large, trailer-like signs with electric generators or photocells that are towed behind a vehicle and left at the detour site. These signs create a large arrow that directs traffic, but the arrow does not guide the driver around a curve or through unfamiliar road courses. Similarly, nautical traffic entering a harbor is guided via buoys and shore-based lights, which when set upon the backdrop of terrestrial lighting, can be confusing. Similarly, emergency or temporary aircraft runways for military, civilian, police, and Coast Guard air equipment, both fixed wing and rotary wing, lack proper sequenced lights that designate direction and location of the runway. This invention provides a system that is both low in cost and easy to implement, one that can be deployed quickly when necessary to aid aviators when landing or taking off on open fields or highways.

SUMMARY OF THE INVENTIONS

The disclosure provided in the following pages describes examples of some embodiments of the invention. The designs, figures, and description are non-limiting examples of some embodiments of the invention. For example, the description of the traffic guiding system relates only to a description of some embodiments of the invention. Other embodiments of the traffic guiding system may or may not include the features disclosed herein. Moreover, disclosed advantages and benefits may apply to only some embodiments of the invention, and should not used to limit the invention.

The inventions include a highway-traffic, aircraft traffic, or nautical warning system that, in an embodiment, comprises flashing lights or other signaling devices, with coordinated sequencing for aiding driver's or a helmsman's directional assessment and orientation. In an embodiment, the system can also comprise audible or auditory sirens, beepers, horns, or other output devices. The system can comprise a plurality of discreet modules, which work together, with the aid of a separate overall control module or by coordinated effort of distributed control modules operably connected to each of the system modules. By working together, the sequenced traffic lights permit an onlooker to visualize which modules are adjacent to each other simply by the order of flashing. This sequencing permits minimum confusion on the part of an onlooker who otherwise might determine that the wrong markers are adjacent because of viewing angle error, parallax, or other visual anomaly, especially when the markers are arranged in a curvilinear fashion.

By sequencing these lights or signaling devices, the driver, pilot, or helmsman can be guided along the proper path without the confusion associated with multiple, randomly flashing lights. Sequenced buoys would aid navigation close to shore. The sequencing system involves controlling the time at which each of the lights in a system can flash on and for what period of time the lights are turned on during the flash. The reader can best appreciate the intent of this new system by envisioning the commonly seen runway landing lights designating the beginning of the runway, which are typically a series of white lights sequenced to provide directional information for the approaching pilot. However, where this new system differs from the prior art is that all such sequenced lights as of this date are controlled via a physical connection between the lights, that is, a cable or wire connects the lights to provide the coordinating signal. This new device controls light-to-light sequencing using radio, infrared, or other wireless transmission means. Each light encompasses appropriate electronic circuitry to both receive and transmit necessary analog and digital information to the next light in sequence. Furthermore, and this is a critical advantage of this new invention, the lights do not have to be numbered, nor does a user have to set each light physically in a particular order. The design provides information inherent in the system, utilizing "mesh", or matrix, technology. There is no need for any user interface, such as a switch, to designate the number of each light. Adjacent lights or modules can be set to recognize their position in a sequence automatically such that the user need not physically set the sequence of module firing. This position recognition can be accomplished using proximity sensors, global positioning receivers, RFID devices, and the like.

In an embodiment, the optical signal emitted out one side of the device can be made visible only from that side and made invisible to those approaching from the other direction. Thus, the system can be made to signal independently, with separate signals or light sources, in different directions, for example, two opposite directions, simultaneously. Expanding upon this unique feature, it is important for the reader to understand that when implemented on a highway, for example, traffic moving in opposite directions will see a progression of flashing lights in their direction of travel. Thus, for example, traffic moving north will see a sequence of lights progressively flashing from south to north, while traffic moving south will see a progression of flashing lights moving from north to south, with both sequencing of lights occurring from the same devices at the same time.

For the purposes of summarizing the invention, certain aspects, advantages and novel features of the invention are described herein. It is to be understood that not necessarily all such advantages may be achieved in accordance with any particular embodiment of the invention. Thus, for example, those skilled in the art will recognize that the invention may be embodied or carried out in a manner that achieves one advantage or group of advantages as taught herein without necessarily achieving other advantages as may be taught or suggested herein. These and other objects and advantages of the present invention will be more apparent from the following description taken in conjunction with the accompanying drawings.

BRIEF DESCRIPTION OF THE DRAWINGS

A general architecture that implements the various features of the invention will now be described with reference to the drawings. The drawings and the associated descriptions are provided to illustrate embodiments of the invention and not to limit the scope of the invention. Throughout the drawings, reference numbers are re-used to indicate correspondence between referenced elements.

DETAILED DESCRIPTION OF THE PREFERRED EMBODIMENTS

The invention may be embodied in other specific forms without departing from its spirit or essential characteristics. The described embodiments are to be considered in all respects only as illustrative and not restrictive. The scope of the invention is therefore indicated by the appended claims rather than the foregoing description. All changes that come within the meaning and range of equivalency of the claims are to be embraced within their scope. Throughout the detailed description and remainder of this document, the author uses the term "traffic" to refer to motor vehicular, nautical, pedestrian, or aircraft movement.

Figure 1:
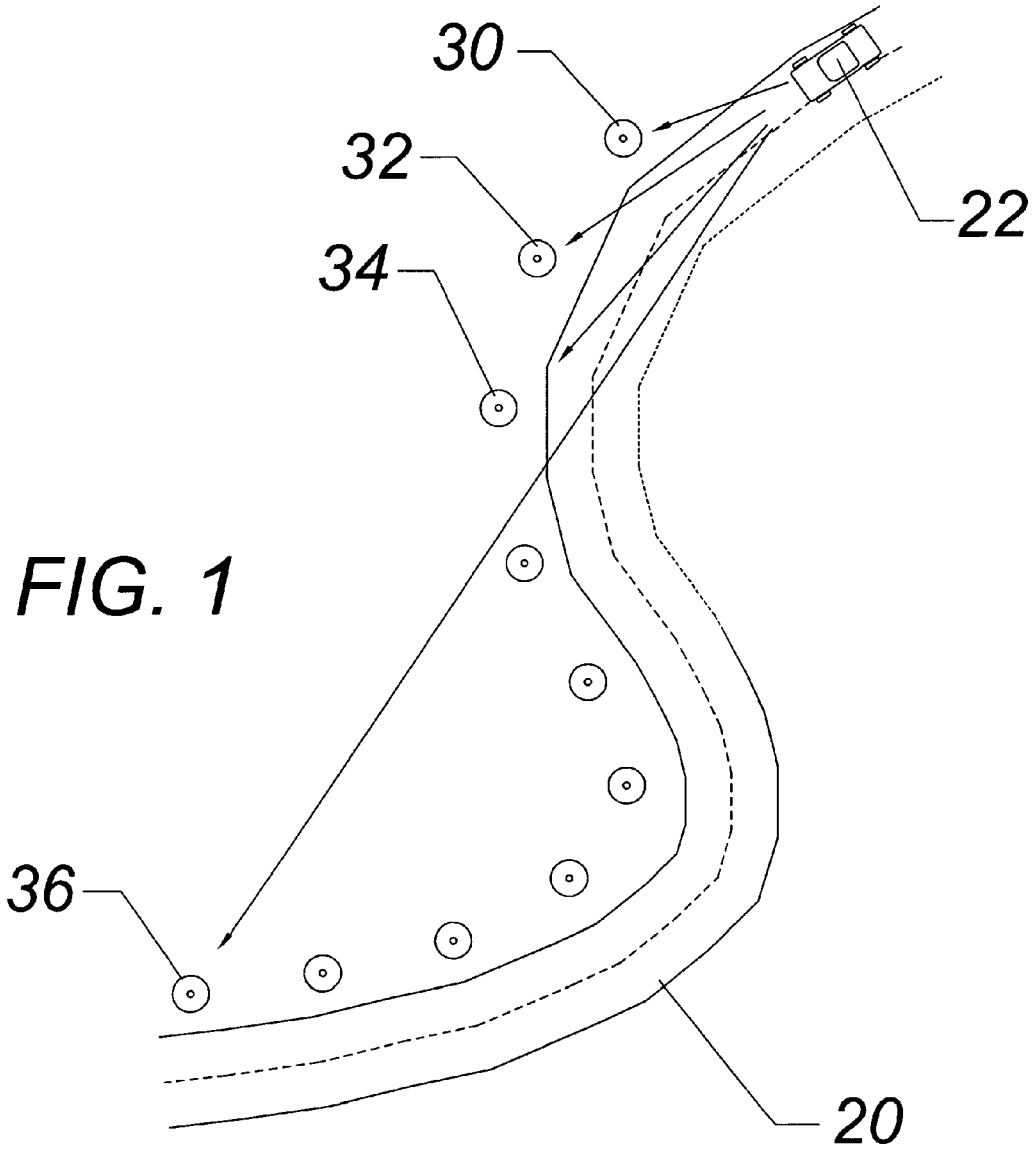
FIG. 1 illustrates a road with an approaching vehicle and a plurality of typical randomly flashing lights, which are currently used and which can cause confusion and disorientation to the vehicle driver, according to an embodiment of the invention.

FIG. 1 illustrates a road 20 with a vehicle 22 driving along the road 20 into a turn. A plurality of flashing markers, including markers 30, 32, 34, and 36, are distributed along side the road 20. These markers 30, 32, 34, 36 can be passive with no illumination or signaling, or they can flash in unsynchronized patterns, in unison, or the like. The driver (not shown) of the vehicle 22 will see these markers and can easily be confused, especially at night, because the contour of the road and the turn may not be clear.

Figure 2:
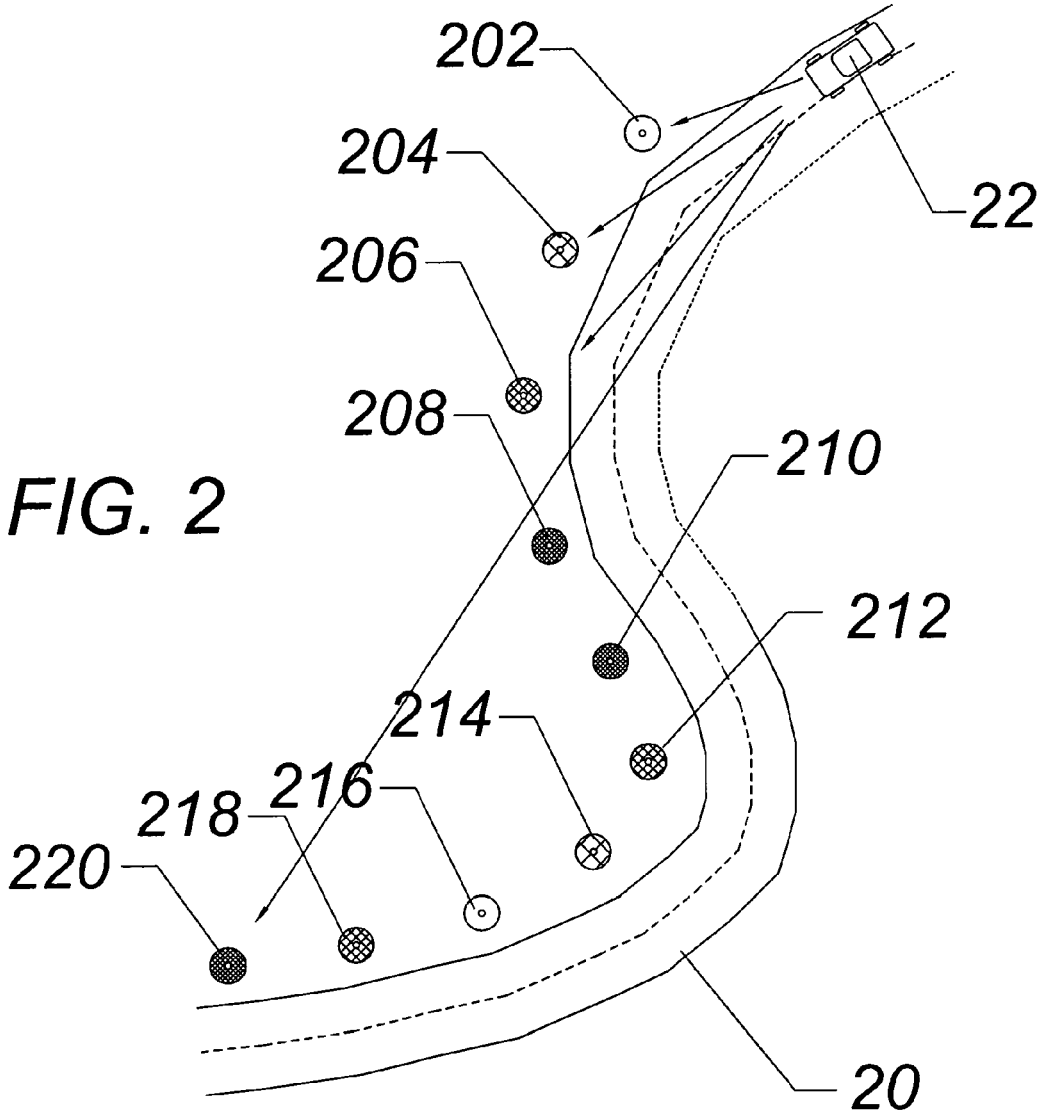
FIG. 2 illustrates a road with an approaching vehicle and a plurality of sequenced lights, which can reduce the confusion to the vehicle driver, according to an embodiment of the invention.

FIG. 2 illustrates a road 20 with a vehicle 22 moving along the road 20 into a turn. A plurality of sequenced flashing markers 202-220 is distributed along the road 20.

Referring to FIG. 2, the lights can be placed alongside a street 20. In this illustration, ten lights 202-220 are distributed around a double corner. The first light 202 is closest to the oncoming car 22 with a tenth light 220 being furthest from the oncoming car. The observer, traveling with the car 22, sees the first light 202 flash on and then turn off. The second light 204 can flash on and then off shortly after light number 202. The third light 206 flashes on and off slightly after light 204 and so on. The observer or driver of the vehicle 22 observes a pattern that guides the eye around the corner of the road 20 in a manner that is not confusing or subject to misinterpretation. The lights, in an embodiment, can further be shaped like arrows pointing in the desired direction of travel. The arrows can be simple chevron shapes or they can be arrows with pointed heads, axially linear bodies, and can even comprise tails. In another embodiment, some lights can be arranged in a group to form a pattern, such as an arrow, whereby all lights in a given pattern or grouping are synchronized to turn on and off at approximately the same time. Thus, although different patterns can turn on and off at different times, lights within the pattern can be linked electronically to turn on and off as a unit, or substantially simultaneously.

When a plurality, defined as a series of two or more, of flashing lights 202-220 are placed on the road 20 or in the water to define a route or detour, or on a temporary runway, sequencing of the flash of each light will aid the driver, pilot, or helmsman in determining the direction of travel. The minimum number of lights 202-220 in a given system is two, while the maximum is unlimited, but practically can include ten, or several hundred, or several thousand, lights over the course of 0.01 miles to 100 miles or more.

Each light 202-220 is controlled by a logic circuit. The first light in the sequence 202 can flash at a rate determined by the user. The rate can be pre-determined, pre-set, or set at the time of installation. When the light flashes on, it sends a signal, either by radio wave, infrared signal, or via hard wire to the next light in sequence, which delays a predetermined time interval before it flashes. Alternatively, the first light 202 can delay a given amount of time prior to sending its signal to the second light 204, and so forth. This 2nd light 204 then sends a signal via radio wave, infrared, or via hard wire to the 3rd light 206 in sequence, and so on. The delay between receiving the trigger signal from the light lower in sequence number and the initiation of the flash is user defined, and may range from milliseconds to several minutes.

Figure 3C:
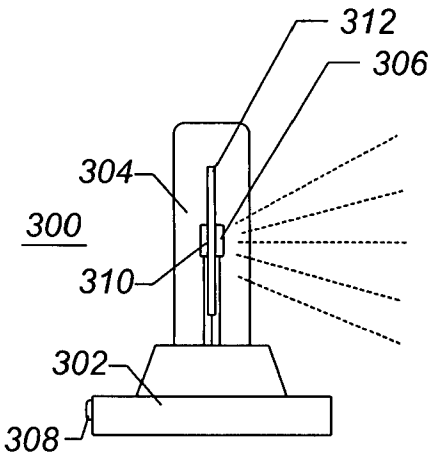
FIG. 3C illustrates a side view of an exemplary signaling device with optical output only on one side and said optical output shielded from view from the other side of the device, according to an embodiment of the invention.
Figure 3B:
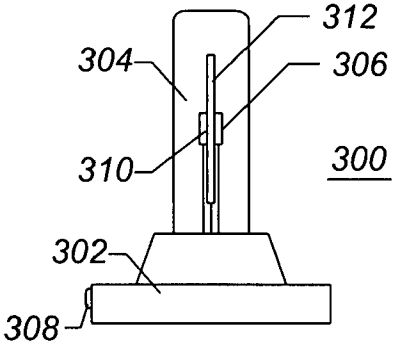
FIG. 3B illustrates a side view of an exemplary signaling device, according to an embodiment of the invention.
Figure 3A:
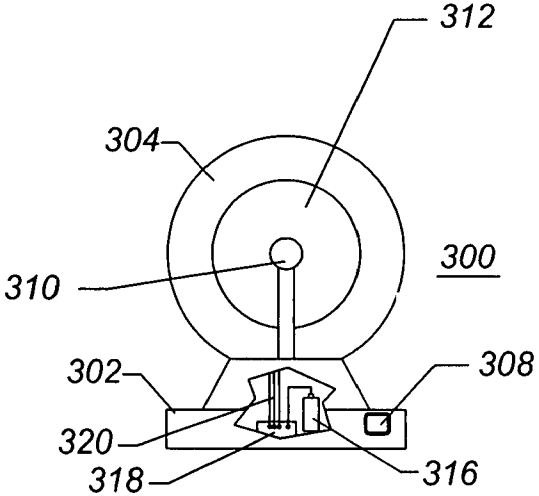
FIG. 3A illustrates a front view of an exemplary signaling device, according to an embodiment of the invention.

FIG. 3A illustrates a front view of a signaling unit 300. The signaling unit 300 comprises a base 302, a signal shell 304, a light source 310, a shield 312, a controller 318, a power supply 316, an on-off switch 308, and an electrical bus 320.

Referring to FIG. 3A, the light source 310, optical output device, or signaling device can be incandescent, light emitting diodes, discharge tube, as in stroboscopic light, fluorescent, etc. The logic circuit or controller 318 can comprise an electronic circuit, further comprising digital, analog, or hybrid technologies. The controller 318 can be fabricated of discreet components or it can be fabricated as a monolithic module or chip that performs all or most of the required functions. The logic circuit or controller 318 further comprises input and output ports that are operably connected to the signaling device 310. The inputs can include electrical power from the power supply 316, control and command input channels, on-off switching 308, and signal receivers. The outputs can include signal transmitters and lights or other optical, audio or other sensory signaling devices.

The power supply 316 of the device can comprise one or more batteries, and can use rechargeable batteries or those that are to be discarded. The batteries or power supply 316 can be operably connected to the power input of each individual system. The power supply 316 can comprise photovoltaic cells (not shown), which may be used to recharge batteries, allowing for sunlight to provide power to the device. The controller can comprise photo detectors to provide the option of the user to have the sequencing and flashing of lights to turn on automatically at sunset, and to turn off at sunrise.

When using radio frequency to send the signal, the range is anticipated to be less than about 100 meters, allowing the use of low-wattage output transmitters. The system can operate using protocols and technologies such as Bluetooth™, ZigBee™, or other standardized short-range protocols in the radio frequency spectrum.

FIG. 3B illustrates a side view of a signaling unit 300. The signaling unit comprises the base 302, the on-off switch 308, the lamp cover 304, the second lamp 306, the first lamp 310, and the illumination shield 312.

Referring to FIG. 3B, the shield 312 can be configured to prevent light from the output device 310 from being seen by an observer looking at the system 300 from a given direction. Thus, in an embodiment, the system 300 can have the option of emitting light in one direction only, providing guidance for traffic in one direction while not being visible by, and thus not having an impact on, traffic from another direction. In an embodiment, traffic coming from opposing directions (substantially 180 degrees apart) can both see the system light 310 but traffic only in the first direction can visualize the illuminated sequencing of the lights while the traffic from the other direction cannot see the lights 310. Directionality can be maintained sufficiently to be visible from traffic with vectors separated by as little as 30 degrees or as much as 180 degrees. Such directionality can be accomplished with baffles, shields, lenses, or the like 312. The system 300 can be incorporated in a unit that will mount onto existing traffic barriers, floating buoy, or incorporated into flexible orange (or other color) traffic cones. The baffles or shields 312 can have their orientation adjusted by installers, once the modules are in place, by rotating the baffles or shields 312 appropriately. In another embodiment, the baffles or shields 312 can automatically be adjusted by detection of the orientation of the other light modules in the system. In addition, the device can be constructed with two LEDs, 306 and 310 each facing in the opposite direction. The device can be programmed to provide proper sequencing for drivers approaching from opposite directions, that is, more than one signaling device 310 can be provided. Each LED or signaling device 310 can be independently linked to the proceeding and trailing light 310 in sequence allowing for the progression of light 310 movement in opposite directions simultaneously.

Further referring to FIG. 3B, different color lights or LEDs, for example 306, 310, can be mounted inside the lamp housing 304 such that the sequence of lights could provide color patterns. For example, the standard color might be yellow, with every $5^{th}$ light revealing red color, such that as the light sequence traverses a distance, every $5^{th}$ light flashes red in progression.

FIG. 3C illustrates a signaling unit 300 when viewed from the side showing light being emitted from the second lamp 306 and visible only from that side of the shield 312. No light coming from lamp 310 can be seen from the direction where lamp 306 shines.

Figure 4:
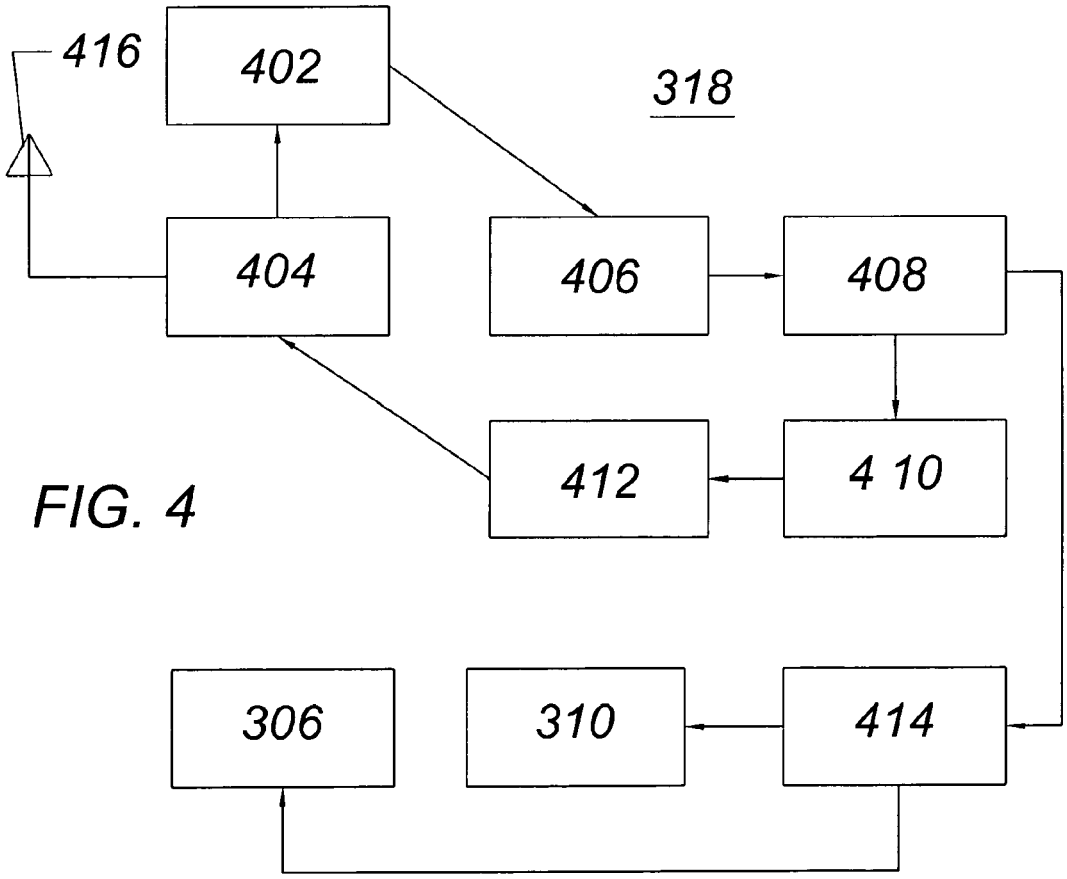
FIG. 4 illustrates a block diagram of the circuitry of the sequenced vehicle light system, according to an embodiment of the invention.

FIG. 4 illustrates a block diagram of the electrical components of the controller 318. The controller 318 comprises a radio frequency (RF) demodulator receiver 402, an RF amplifier 404, a decoder 406, a micro controller 408, an encoder 410, an RF transmitter 412, an LED driver 414, a first LED 310, a second LED 306, and an antenna 416.

The functional diagram of FIG. 4 reveals a radio receiver 402 that detects a digital code modulated on a radio frequency signal. This signal is demodulated, and the resulting digital code is provided as input to the decoder 406. In an exemplary embodiment, each device transmits this code, three times. If the code matches the appropriate sequence number of this unit on all three occasions, then the microcontroller 408 provides a confirmation signal, which then utilizes the LED driver 414 to turn on the first LED 310. At the same time, the microcontroller 408 sends a signal to the encoder 410, which provides a coded digital signal to a modulator (not shown) and then to the radio transmitter 412. This digitally encoded radio signal is now transmitted to all neighboring units. Only the unit next in sequence that matches this code will respond with the appropriate flash of the LED 310 mounted thereon.

The microcontroller 408 can be receiving multiple signals in rapid succession, and this provides the opportunity for the microcontroller 408 to turn on or off two or more LEDs 310, 306 at the appropriate time. This results in the capability of having multiple simultaneous progressive flashing sequencing for traffic moving in opposite directions.

Each device's sequence number can be programmed using an input keyboard, an electrical transmission from an external controller, or hardwired and controlled by a local switch such as thumbwheel or membrane switch. The sequence can be input through the individual module control input port. It can also be programmed from a distance using radio frequency, microwave, inductance, infrared or other electromagnetic radiation. Hence, the devices, or modules, can be deployed without regard to sequence number, and when in place, the user can simply walk along the path and define each devices sequence number. However, the unique aspect of this invention is the use of a "mesh" network that allows for the lights to assume the proper sequence number simply by applying power in the proper order or with proximity sensors. For example, in an embodiment, the user would simply locate a light and turn it on. The electronic circuitry and logic would "listen" to detect whether there were any other lights currently on and transmitting a signal. If no other signal is received in a predetermined period of time, then this device would assume identity number 1. When the $2^{nd}$ light is turned on, it would listen for any other devices, and upon "hearing" number 1 transmitting a signal, but no other transmitted signals, it would then say, "I must be number 2". When turned on, the $3^{rd}$ light would receive (or "hear") numbers 1 and 2, and if no other signals were heard it would then assume that "I must be number 3", and so on. When used in a nautical setting, the buoys could be activated in order when placed in the water. In addition, the user can define the length of flash and the delay between reception of triggering signal and flash with input on the control panel of each device. In other embodiments, an array of modules is placed and once activated, would self-determine their order in the array, position in the system, etc., and set the activation sequence accordingly.

The flashing sequence is programmable, and may reverse to produce a particular guide or warning. Furthermore, a failure of one unit would not influence performance of the entire system. Should one unit fail, the next higher number will wait a predetermined number of milliseconds, and upon failing to receive a transmission from the failed unit, will continue to operate without interruption. This same methodology, that is the mesh network, provides a simple means by which a failed unit could be replaced. The person replacing the failed unit simply has to turn the replacement unit on. It will listen for a predetermined length of time. If it "hears" a number 10, for example, and a number 12, but no signal is received from a number 11, then it will assume that number 11 is out of the system and simply adopt that code number.

In another embodiment, the system of lights or modules can be configured to provide an indication of distance from the observer. The signaling system, of which the lights are the most visible part of each module, can comprise lights that are visibly dimmer the higher the number in the sequence to which they are assigned (or the opposite). The lights can, in another embodiment, illuminate at different visible wavelengths to provide some indication of distance. While this methodology is not as effective for a color-blind person, longer frequency colors such as the reds appear to be different distances from an observer than do colors near the cooler end of the spectrum (blue for example). Thus lights with lower sequence numbers can illuminate at different emission frequencies than lights, which are assigned higher numbers in the sequence. In another embodiment, the lights can be assigned to flash on for shorter periods of time, the further they are from the observer (higher in the sequence chain) than lights, which are closer to the observer (lower in the sequence chain). Thus, the lights, which are on longer will appear to be relatively brighter and thus closer to the observer. In yet another embodiment, the lights that are closer to the observer can flash on and off a number of times during their assigned "on" cycle. Lights further from the observer can be assigned to flash on and off a relatively lower number of times during their "on" cycle, thus appearing slightly dimmer or further away from the observer. Any combination of the aforementioned systems can be used to assist the driver or observer in determining the path in which the lights or signaling devices are arrayed, and thus the safe path that can be followed by the observer.

Figure 5:
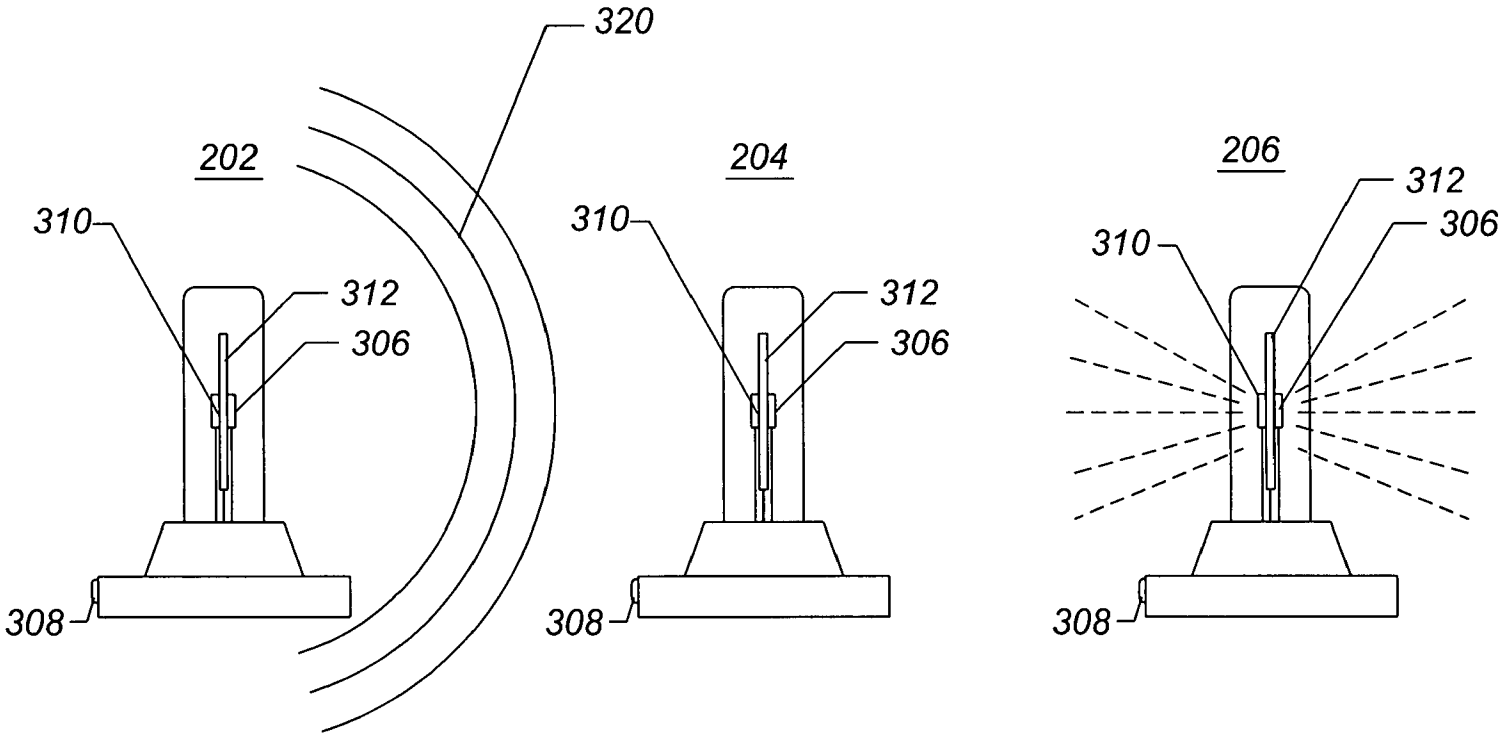
FIG. 5 illustrates three sequenced lights configured for traffic flow visualization, according to an embodiment of the invention.

FIG. 5 illustrates the logic control used to create sequenced flashing of lights as illustrated in FIG. 2. FIG. 5 shows module number 202 comprising the light or sensory signaling devices 306,310, the controller, and a shield 312. The controller for light number 202 is shown transmitting an electromagnetic signal 320 to the controller for light number 204. There is no signal being emitted between the controller, or module, for light number 20 and the controller or module for light number 206 at this point in time. The signal from module number 204 to module number 206 will be generated at a future instant in time. The shield or baffle 312 prevents viewing of the lights 306, 310 from an undesired direction, thus preventing confusion on the part of drivers coming from an oncoming direction, for example. Both lamp 306 and 310 are illuminated in module 206.

A system of signal emitting modules 300 is disclosed. The modules emit light or other signals to warn oncoming traffic that a road or other pathway has changed or is traversing a tortuous pathway. The modules 300 are interconnected in a sequence so that they flash on and off in a pattern that leads the driver or observer along a path with less confusion than with randomly flashing or steady lights or reflectors. The modules are self-powered and can be arrayed first and programmed following deployment. The programming can be done with the described mesh technology, an external controller, or by dialing a specific number in each of a plurality of distributed controllers. The modules can improve highway safety by reducing driver confusion. The modules are arrayed to prevent a driver from seeing them from an oncoming direction, or, using two independent sequencing software programs for opposite facing LEDs, the driver coming from the opposite direction will have his or her own guiding system.

The visual output device, which can be a light, led, or other visual emitter can be highly directional, omni-directional, or quasi-directional. Each visual output device can be set to emit electromagnetic radiation in the visible range or a range outside the visible spectrum. Such radiation can be in the infrared, ultraviolet, microwave, or radio frequency range. Such radiation can be configured to be received by, and interact with, a receiver in an approaching or departing vehicle that can display the information on a Global Positioning System (GPS) display or other mapping device within the vehicle. Furthermore, each module supporting the visual output devices can comprise a GPS receiver that can provide its position and then transmit that position to the approaching or leaving vehicle such that the information may be used to locate one, a few, or all of the modules on a GPS display or other mapping system.

The present invention may be embodied in other specific forms without departing from its spirit or essential characteristics. The described embodiments are to be considered in all respects only as illustrative and not restrictive. The scope of the invention is therefore indicated by the appended claims rather than the foregoing description. All changes that come within the meaning and range of equivalency of the claims are to be embraced within their scope.

For purposes of summarizing the invention, certain aspects, advantages and novel features of the invention are described herein. It is to be understood that not necessarily all such advantages may be achieved in accordance with any particular embodiment of the invention. Thus, for example, those skilled in the art will recognize that the invention may be embodied or carried out in a manner that achieves one advantage or group of advantages as taught herein without necessarily achieving other advantages as may be taught or suggested herein.

What is claimed is:

1. A system for marking a route, path or boundary, said system comprising:

a plurality of modules, each module comprising a signaling device, a radiofrequency apparatus and a control circuitry;

the modules being positionable in an array which marks a route, path or boundary;

whereby the modules positioned in the array will undergo radiofrequency communication with one another and the control circuitry will cause the signaling devices of the modules to emit warning signals in sequence from a first-positioned module of the array to a last-positioned module of the array;

wherein the control circuits are operative to automatically transmit radiofrequency signals from one module to the next, without required reference to a common reference signal, such that the modules determine their sequential order in the array and emit signals in that self-determined sequential order.

2. A system according to claim 1 wherein the radiofrequency communication between the modules is wireless.

3. A system according to claim 1 wherein the signaling devices emit visible warning signals.

4. A system according to claim 1 wherein the signaling devices emit warning signals which are not visible but which may be received and sensed by apparatus operative to receive and sense said warning signals.

5. A system according to claim 4 further comprising apparatus operative to receive and sense said warning signals.

6. A system according to claim 1 wherein the signaling devices comprise light emitters which emit flashes or periods of light.

7. A system according to claim 1 wherein the signaling devices comprise devices selected from the group of: incandescent lamps; light emitting diodes; discharge tubes; stroboscopic lights; fluorescent lights; light emitters that emit visible light; light emitters that emit light which is not visible but which is detectable by a sensor, infrared lights, ultraviolet lights; microwave emitters and radio frequency emitters.

8. A system according to claim 1 wherein each module further comprises a power source.

9. A system according to claim 8 wherein each module comprises a power source selected from: batteries; photovoltaic cells; wind energy; and thermal energy.

10. A system according to claim 1 wherein the control circuits comprise a mesh network.

11. A system according to claim 1 wherein the control circuits comprise position-determining apparatus selected from: proximity sensors; global positioning receivers and RFID devices to facilitate determination of the respective positions of modules in the array.

12. A system according to claim 1 wherein the control circuits are operative to determine when a module of the array becomes missing or non-functional and to allow a replacement module to assume that identified module's position in the array.

13. A system according to claim 1 wherein the control circuits are adapted to allow some of the modules within the array to be grouped in one or more subsets and to thereafter cause the signaling devices on the modules within each subset to emit warning signals that are simultaneous or otherwise different from warning signals emitted by other modules that are not within that subset.

14. A system according to claim 1 wherein the modules are adapted to emit warning signals which can be viewed or received and sensed from one vantage point but not from another vantage point.

15. A system according to claim 14 wherein the warning signals can be viewed or received and sensed by traffic traveling in a first direction but not by traffic traveling in a second direction that is substantially opposite the first direction.

16. A system according to claim 14 wherein the signal emitters emit flashes or periods of light and wherein the modules comprise baffles which cause the emitted flashes or periods of light to be viewed or received and sensed from one vantage point but not from another vantage point.

17. A method for marking a route, path or boundary, said method comprising the steps of:

A) obtaining or providing a system which comprises a plurality of modules, each module comprising a signaling device, a radiofrequency apparatus and control circuitry, wherein the modules are positionable in an array which marks a route, path or boundary and wherein the control circuits of the modules are operative, when the modules are positioned in said array, to transmit radiofrequency signals from one module to the next, without required reference to a common reference signal, such that the modules emit warning signals in a sequence from a first module of the array to a last module of the array;

B) positioning modules of the system in an array which marks a route, path or boundary; and, C) actuating and causing the modules to communicate with one another via the radiofrequency apparatus and to emit said signals in sequence from a first module of the array to a last module of the array.

18. A method according to claim 17 wherein the route, path or boundary is selected from: highways; roads; detours; temporary airfields; runways; landing zones; nautical channels; aircraft routes; traffic regions and vehicular traffic routes or patterns.

19. A method according to claim 17 wherein the modules are constructed such that the emitted flashes or periods of light are visible or received and sensed from one vantage point but not another and wherein Step B comprises positioning the modules so that the emitted signals viewed or received and sensed by traffic traveling in one direction but not by traffic traveling in another direction.

* * * * *